US005218931A

United States Patent [19]

Gorzegno

[11] Patent Number: 5,218,931

[45] Date of Patent: Jun. 15, 1993

[54] FLUIDIZED BED STEAM REACTOR INCLUDING TWO HORIZONTAL CYCLONE SEPARATORS AND AN INTEGRAL RECYCLE HEAT EXCHANGER

[75] Inventor: Walter P. Gorzegno, Morristown, N.J.

[73] Assignee: Foster Wheeler Energy Corporation, Clinton, N.J.

[21] Appl. No.: 792,565

[22] Filed: Nov. 15, 1991

[51] Int. Cl.[5] ..... F22B 1/00

[52] U.S. Cl. ..... 122/4 D; 110/245; 432/15; 432/58

[58] Field of Search ..... 122/4 D; 110/245; 432/15, 58

[56] References Cited

U.S. PATENT DOCUMENTS

| | | | |
|---|---|---|---|
| 928,673 | 6/1909 | Lebrasseur . | |
| 2,339,416 | 2/1941 | McDonald . | |
| 2,973,094 | 2/1961 | Lundy . | |
| 3,893,426 | 6/1975 | Bryers . | |
| 4,111,158 | 9/1978 | Reh et al. . | |
| 4,165,717 | 8/1979 | Reh et al. . | |
| 4,338,283 | 6/1982 | Sakamoto et al. . | |
| 4,469,050 | 9/1984 | Korenberg . | |
| 4,664,887 | 5/1987 | Engstrom . | |
| 4,672,918 | 6/1987 | Engstrom et al. | 122/4 D |
| 4,686,939 | 8/1987 | Stromberg . | |
| 4,694,758 | 9/1987 | Gorzegno et al. . | |
| 4,699,068 | 10/1987 | Engstrom . | |
| 4,708,092 | 11/1987 | Engstrom . | |
| 4,709,662 | 12/1987 | Rawdon . | |
| 4,716,856 | 1/1988 | Beisswenger et al. . | |
| 4,731,228 | 3/1988 | Dewitz et al. . | |
| 4,732,113 | 3/1988 | Engstrom . | |
| 4,755,134 | 5/1988 | Engstrom et al. . | |
| 4,813,380 | 3/1989 | Engstrom . | |
| 4,813,479 | 3/1989 | Wahlgren . | |
| 4,856,460 | 8/1989 | Wied et al. . | |
| 4,864,944 | 9/1989 | Engstrom et al. | 122/4 D |
| 4,896,717 | 1/1990 | Campbell, Jr. et al. . | |
| 4,947,804 | 8/1990 | Abdulally . | |
| 4,969,930 | 11/1990 | Arpalahti . | |
| 5,005,528 | 4/1991 | Virr | 122/4 D |

*Primary Examiner*—Henry G. Yuen

*Attorney, Agent, or Firm*—Marvin A. Naigur

[57] ABSTRACT

A fluidized bed reactor in which partitions disposed within a vessel form first and second furnace sections, first and second troughs and a heat exchange section such that the first trough is disposed between the first furnace section and the heat recovery section and the second trough is disposed between the second furnace section and the heat recovery section. A fluidized bed is formed in each of the furnace sections for the combustion of fuel to generate heat and to generate a mixture of combustion gases and entrained particulate solids. The mixtures from the furnace sections are received in first and second horizontal cyclone separators, both formed within the vessel for separating the entrained particulate solids from the combustion gases. Outlet means extend from the horizontal cyclones to discharge the separated solids to the first and second troughs respectively. The troughs are divided into first and second sets of compartments with slanted roofs disposed between the cyclone separators and the second sets of compartments for directing the separated solids into the first sets of compartments. Openings are formed in the partitions for permitting the passage of the separated solids from the first sets of compartments into the heat recovery section, for permitting the passage of the separated solids from the heat recovery section to the second sets of compartments, and for permitting the passage of the separated solids from the second sets of compartments to the first and second furnace sections.

36 Claims, 3 Drawing Sheets

FLUIDIZED BED STEAM REACTOR INCLUDING TWO HORIZONTAL CYCLONE SEPARATORS AND AN INTEGRAL RECYCLE HEAT EXCHANGER

FIELD OF THE INVENTION

This invention relates in general to fluidized bed steam generation systems, and, more particularly, relates to a fluidized bed steam reactor which includes two horizontal cyclone separators for separating solid particles from the gases generated by the combustion of fuel and an integral recycle heat exchanger for removing heat from the separated solids.

BACKGROUND OF THE INVENTION

Fluidized bed combustion reactors are well known. These arrangements include a furnace section in which air is passed through a bed of particulate material, including a fossil fuel, such as coal, and an adsorbent for the sulfur released as a result of combustion of the coal, to fluidize the bed and to promote the combustion of the fuel at a relatively low temperature. When the heat produced by the fluidized bed is utilized to convert water to steam, such as in a steam generator, the fluidized bed reactor offers an attractive combination of high heat release, high sulfur adsorption, low nitrogen oxides emissions and fuel flexibility.

The most typical fluidized bed reactor includes what is commonly referred to as a bubbling fluidized bed in which a bed of particulate material is supported by an air distribution plate, to which combustion supporting air is introduced through a plurality of perforations in the plate, causing the material to expand and take on a suspended, or fluidized, state. The hot flue gases produced by the combustion of the fuel are passed to a heat recovery area to utilize their energy.

In the event the reactor is in the form of a steam generator, the walls of the reactor are formed by a plurality of heat transfer tubes. The heat produced by combustion within the fluidized bed is transferred to a heat exchange medium, such as water, circulating through the tubes. The heat transfer tubes are usually connected to a natural water circulation circuitry, including a steam drum, for separating the steam thus formed which steam is then routed to a steam user or to a turbine to generate electricity.

In an effort to extend the improvements in combustion efficiency, pollutant emissions control, and operation turn-down afforded by the bubbling bed, a circulating fluidized bed reactor has been developed utilizing an expanded and elutriating fluidized bed. According to this technique, the fluidized bed density may be below that of a typical bubbling fluidized bed, with the air velocity equal to or greater than that of a bubbling bed. The formation of the low density elutriating fluidized bed is due to its small particle size and to a high solids throughput, a result of the flue gases entraining a substantial amount of the fine particulate solids. This high solids throughput requires greater solids recycling which is achieved by disposing a separator at the furnace section outlet to receive the flue gases, and the solids entrained therein, from the fluidized bed. The solids are separated from the flue gases in the separator and the flue gases are passed to a heat recovery area while the solids are recycled back to the furnace.

The high solids circulation required by the circulating fluidized bed makes it insensitive to fuel heat release patterns, thus minimizing the variation of the temperature within the reactor, and therefore decreasing the nitrogen oxides formation. Also, this high solids recycling improves the efficiency of the separator. The resulting increase in sulfur adsorbent and fuel residence times reduces the adsorbent and fuel consumption. Furthermore, the circulating fluidized bed inherently has more turn-down capability than the bubbling fluidized bed.

U.S. Pat. Nos. 4,809,623 and 4,809,625, assigned to the same assignee as the present application, disclose a fluidized bed reactor in which a dense, or bubbling, fluidized bed is maintained in the lower portion of the furnace section, while the bed is otherwise operated as a circulating fluidized bed. This "hybrid" design is such that advantages of both a bubbling bed and a circulating bed are obtained, not the least significant advantage being the ability to utilize particulate fuel material extending over a greater range of particle sizes.

In the operation of these types of fluidized beds, and, more particularly, those of the circulating and hybrid types, there are several important considerations. For example, the flue gases and entrained solids must be maintained in the furnace section at a particular temperature (usually approximately 1600° F.) consistent with proper sulfur capture by the adsorbent. As a result, the maximum heat capacity (head) of the flue gases passed to the heat recovery area and the maximum heat capacity of the separated solids recycled through the separator to the furnace section are limited by this temperature. In a cycle requiring only superheat duty and no reheat duty, the heat content of the flue gases at the furnace section outlet is usually sufficient to provide the necessary heat for use in the heat recovery area of the steam generator downstream of the separator. Therefore, the heat content of the recycled solids is not needed.

However, in a steam generator using a circulating or hybrid fluidized bed with sulfur capture and a cycle that requires reheat duty as well as superheater duty, the existing heat available in the flue gases at the furnace section outlet is not sufficient. At the same time, heat in the reactor separator recycle loop is in excess of the steam generator duty requirements. For such a cycle, the design must be such that the heat in the recycled solids be utilized before the solids are reintroduced to the furnace section.

To provide this extra heat capacity, a recycle heat exchanger is sometimes located between the separator solids outlet and the fluidized bed of the furnace section. The recycle heat exchanger includes heat exchange surfaces and receives the separated solids from the separator and functions to transfer heat from the solids to the heat exchange surfaces at relatively high heat transfer rates before the solids are reintroduced to the furnace section. The heat acquired by the heat exchange surfaces is then transferred to cooling circuits to supply reheat and/or superheat duty.

There are, however, some disadvantages associated with this type of operation. For example, a dedicated structure must be employed to house the recycle heat exchanger which must be fully insulated and include a fluidization system. Further, the solids are usually directed from the recycle heat exchanger through one discharge pipe to one relatively small area of the furnace section which is inconsistent with uniform mixing and distribution of the solids required for optimal efficiency.

Besides sometimes requiring recycle heat exchangers, circulating or hybrid fluidized bed combustion reactors also require relatively large separators for the separation of the entrained solid particles from the flue gases and for the solids recycle. A cyclone separator is commonly used which includes a vertically oriented, cylindrical vortex chamber in which a central gas outlet pipe is disposed for carrying the separated gases upwardly, while the separated particles exit the separator through its base. These so-called vertical cyclone separators are substantial in size and eliminate the possibility of a compact system design which can be modularized and easily transported and erected. For larger combustion systems, several vertical cyclone separators are often required to provide adequate particle separation, which compound the size problem and, in addition, usually require complicated gas duct arrangements with reduced operating efficiency. These ducts also require substantial amounts of costly refractory insulation to minimize heat loses.

Other problems also exist with the use of vertical cyclone separators since they require costly and complex components to deliver the separated particles back to the reactor's fluidized bed o to a recycle heat exchanger. For example, a gravity chute or a pneumatic transport system is required which must include a sealing device such as a sealpot, a siphon seal or a "J" or "L" valve due to the pressure differential between the low pressure cyclone discharge and the high pressure furnace section. Expansion joints are also required to connect the separator to the chute or transport system to reduce stresses caused by the high temperature differentials experienced.

To eliminate many of the above mentioned problems, horizontal cyclone separators characterized by a horizontally-oriented vortex chamber have been constructed. Horizontal cyclone separators may be readily configured within the upper portion of the furnace section and integrated with the walls of the furnace. However, known horizontal cyclone separators have various shortcomings, particularly with providing recycle heat exchange with the separated solids before the solids are reintroduced to the furnace section.

SUMMARY OF THE INVENTION

It is therefore an object of the present invention to provide a fluidized bed reactor which utilizes a recycle heat exchanger disposed integrally with the furnace section of the reactor.

It is a further object of the present invention to provide a fluidized bed reactor of the above type in which heat exchange surfaces are provided in the recycle heat exchanger to remove heat from the separated solids to provide additional heat to a fluid circuit associated with the reactor.

It is a still further object of the present invention to provide a fluidized bed reactor of the above type in which the recycle heat exchanger includes a direct bypass opening for routing the separated solids directly to the furnace section without passing over any heat exchange surfaces.

It is a still further object of the present invention to provide a fluidized bed reactor of the above type in which the recycle heat exchanger includes multiple outlets to insure that the separated solids are uniformly distributed to the furnace section.

It is a still further object of the present invention to provide a fluidized bed reactor of the above type in which conventional cyclone separators are replaced with horizontal cyclone separators.

It is a still further object of the present invention to provide a fluidized bed reactor of the above type in which the quantity and temperature levels of the flue gases passing through the reheater and the superheater, respectively, can be independently controlled over the load range.

It is a still further object of the present invention to provide a fluidized bed reactor of the above type which eliminates the need for pneumatic transport devices between the separator and the furnace section of the reactor.

It is a still further object of the present invention to provide a fluidized bed reactor which is relatively compact in size, can be modularized and is relatively easy to erect.

It is a still further object of the present invention to provide a fluidized bed reactor of the above type in which the bulk, weight and cost of the cyclone separators are much less than that of conventional separators.

It is a still further object of the present invention to provide a fluidized bed reactor of the above type in which heat losses are minimized.

It is still further object of the present invention to provide a fluidized bed reactor of the above type which is utilized to generate steam and, in particular, to provide a very large fluidized bed steam generator system in the range of 500 MW and larger.

Toward the fulfillment of these and other objects, the fluidized bed reactor of the present invention includes two furnace sections, two horizontal cyclone separators and a heat exchange section disposed between the two furnace sections, all formed within one vessel. A bed of solid particulate material including fuel is supported in each furnace section and air is introduced into each bed at a velocity sufficient to fluidize the material and support the combustion or gasification of the fuel. A mixture of air, the gaseous products of the combustion, and solid particles entrained by the air and the gaseous products is directed from each bed to one of the horizontal cyclone separators which are located above each bed in the upper portion of the vessel.

The horizontal cyclone separators include vortex chambers having inlet ducts which extend the full width of their respective furnace sections for receiving the mixture and separating the particles from the mixture by centrifugal action. Central outlet cylinders are provided for directing the clean gases out of the chambers and out of the vessel s that their heat can be productively utilized, such as in the heat recovery area of a steam generator. The particles separated from the mixture then fall from the separators through outlet ducts and settle in troughs which extend between the heat exchange section and each furnace section. The troughs ar partitioned to first direct the separated particles into the heat exchange section and then into the furnace sections. Additionally, bypass openings are provided in the troughs for directing the separated particles directly into the furnace sections, bypassing the heat exchange section. The troughs and the heat exchange section are fluidized with sufficient air velocity to permit the required flow of the separated particles.

BRIEF DESCRIPTION OF THE DRAWINGS

The above brief description as well as further objects, features and advantages of the present invention will be more fully appreciated by reference to the following detailed description of presently preferred but nonetheless illustrative embodiments in accordance with the present invention when taken in conjunction with the accompanying drawings in which.

DESCRIPTION OF THE PREFERRED EMBODIMENT

Figure 1:
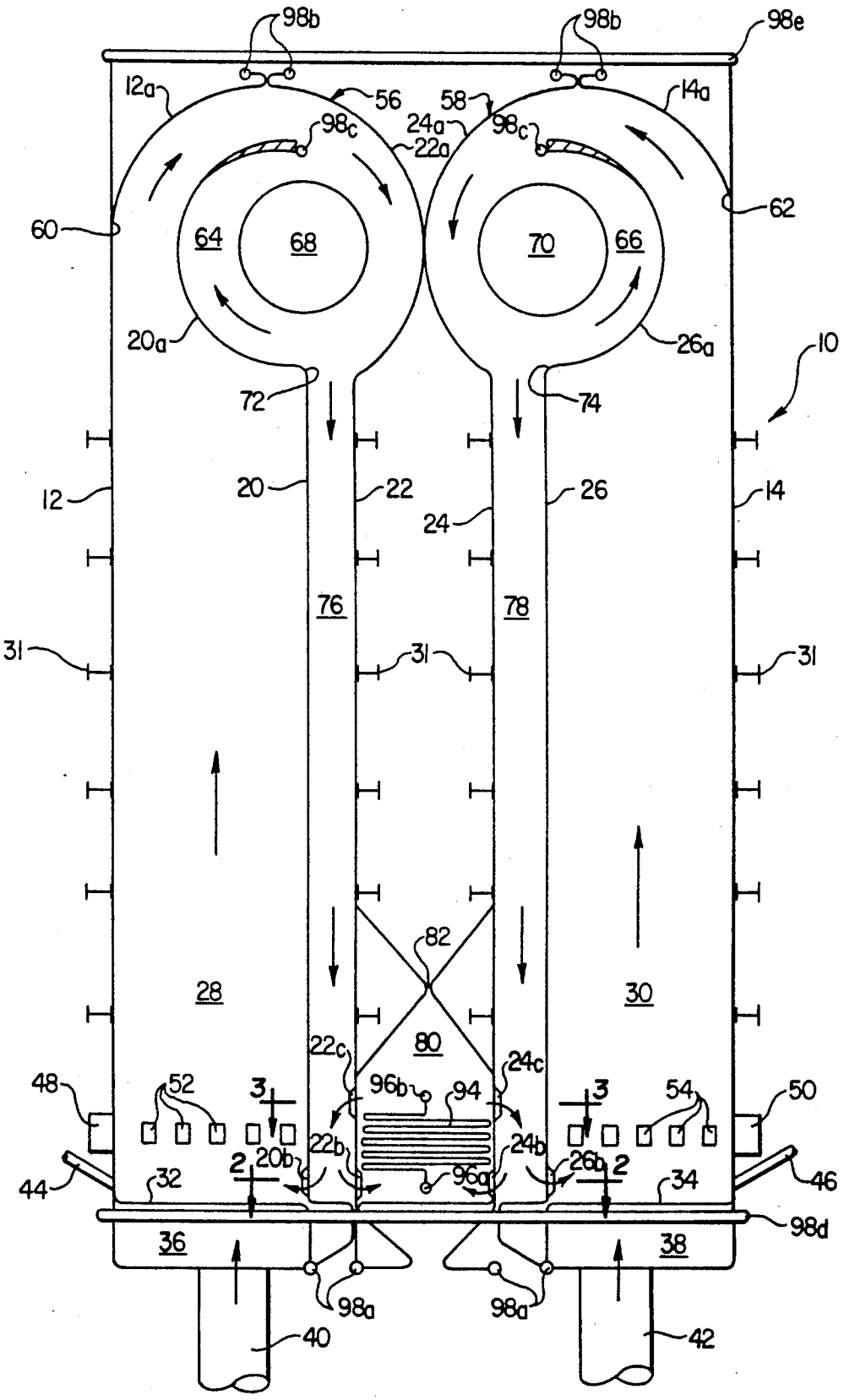
FIG. 1 shows a schematic view, partially in section, depicting the fluidized bed reactor of the present invention.

Referring to FIG. 1 of the drawings, the reference numeral 10 refers to the fluidized bed reactor of the present invention which forms a portion of a steam generating system connected to the reactor by fluid flow circuitry, subsequently discussed.

Figure 2:
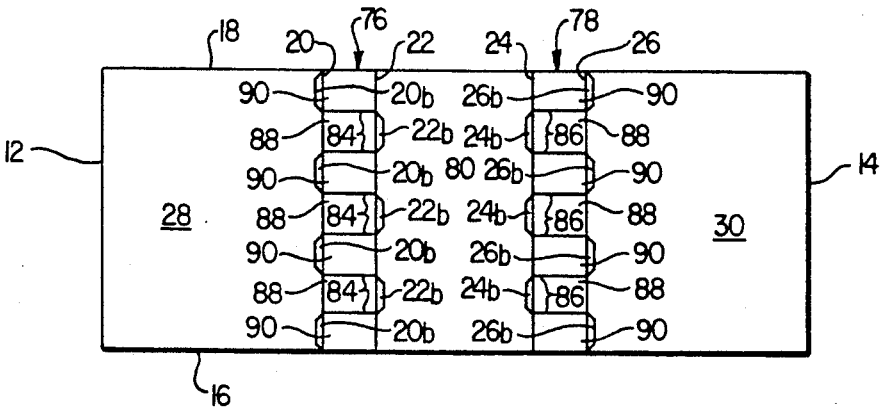
FIG. 2 shows a section taken along the line 2—2 of FIG. 1.

The reactor 10 includes a generally rectangular vessel defined by a front wall 12, a spaced, parallel rear wall 14 and first and second sidewalls 16 and 18 (FIG. 2) extending perpendicular to the walls 12 and 14. First, second, third and fourth intermediate partitions 20, 22, 24 and 26 extend between the walls 12 and 14 in a spaced, parallel relation thereto and contain curved upper portions 20*a*, 22*a*, 24*a* and 26*a*, respectively. The wall 12 and the partition 20, along with corresponding portions of the sidewalls 16 and 18, form a generally rectangular first furnace section 28. A second generally rectangular furnace section 30 is formed by the wall 14 and the partition 26, along with corresponding portions of the sidewalls 16 and 18. The walls 12, 14, 22 and 24 and the sidewalls 16 and 18 are structurally supported by buckstays 31.

Perforated air distribution plates 32 and 34 are suitably supported at lower portions of the furnace sections 28 and 30, respectively, and help define plenum chambers 36 and 38. Primary air from a suitable source (not shown) is introduced into the plenum chambers 36 and 38 by conventional means through pipes 40 and 42. The air introduced into the plenum chambers 36 and 38 passes in an upwardly direction to the air distribution plates 32 and 34 and may be preheated by air preheaters (not shown) and appropriately regulated by air control dampers (also not shown) as needed.

The air distribution plates 32 and 34 are adapted to support beds of particulate fuel material consisting, in general, of crushed coal for burning and limestone, or dolomite, for adsorbing the sulfur formed during the combustion of the coal. A plurality of fuel distributor pipes 44 and 46 extend through the front wall 12 and the rear wall 14 respectively for introducing particulate fuel into the furnace sections 28 and 30, it being understood that other pipes can be associated with the walls defining the furnace sections for distributing particulate sorbent material and/or additional particulate fuel material into the furnace sections as needed. It is understood that drain pipes (not shown) register with openings in the sidewalls 16 and 18 just above the air distribution plates 32 and 34 for discharging spent fuel and sorbent material from the furnace sections 28 and 30 to external equipment.

Openings 48 and 50 extend through the walls 12 and 14 at a predetermined elevation above the plates 32 and 34 to introduce secondary air into the furnace sections 28 and 30, for reasons to be described. It is understood that a plurality of air ports such as those referred to by reference numerals 52 and 54, at one or more elevations, can be provided through any of the furnace section walls for discharging air into the furnace sections.

First and second horizontal cyclone separators 56 and 58 are provided in an upper portion of the vessel formed by the reactor 10. Cyclone separator inlet ducts 60 and 62 are provided to pass the mixture of combustion gases and products from the furnace sections 28 and 30 into the separators 56 and 58, respectively, and specifically into vortex chambers 64 and 66 for separating the solid particles from the mixture in a manner to be described. The inlet duct 60 is defined by a curved wall 12*a* extending from the front wall 12 and the upper portion of the laterally spaced curved portion 20*a* of the partition 20. Likewise, the inlet duct 62 is defined by a curved wall 14*a* extending from the rear wall 14 and the upper portion of the laterally spaced curved portion 26*a* of the partition 26. Both inlet ducts 60 and 62 extend the full width of the furnace sections 28 and 30.

Figure 6:
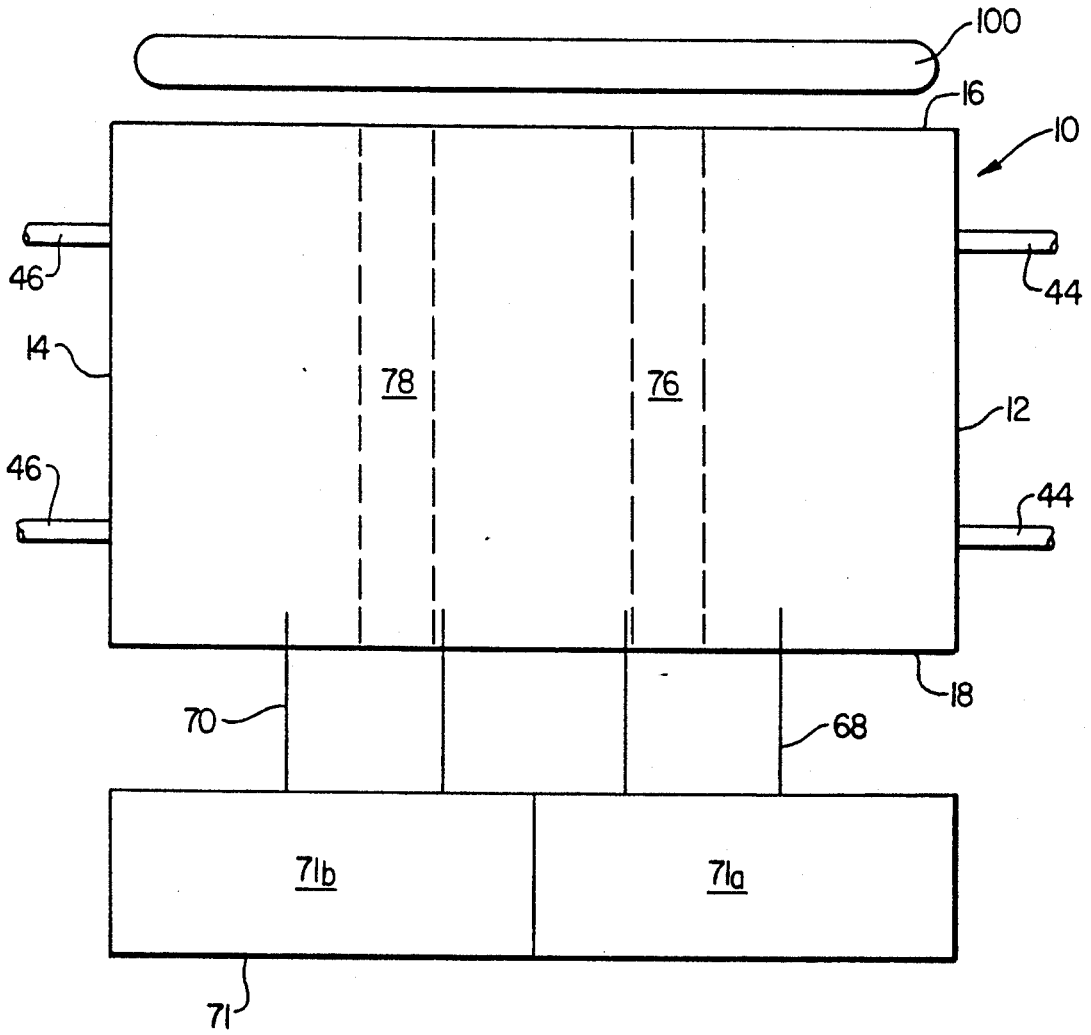
FIG. 6 shows a plan view of the fluidized bed reactor of the present invention.

The vortex chambers 64 and 66 are generally cylindrical and defined by the curved portions 20*a* and 22*a* of the partitions 20 and 22 and the curved portions 24*a* and 26*a* of the partitions 24 and 26, respectively. Central outlet cylinders 68 and 70 extend coaxially within a portion of the vortex chambers 64 and 66 respectively for receiving clean gases from the vortex chambers and passing them, as shown in FIG. 6, to a heat recovery area 71. The heat recovery area 71 is comprised of a first section 71*a* fed by the cylinder 68 and housing a reheater (not shown) and a second section 71*b* fed by the cylinder 70 and housing a superheater and an economizer (not shown). The cylinders 68 and 70 extend from the sidewall 18 and are sufficient in length to promote the re-entrant flow of the clean gases to exit the separators 56 and 58 to the heat recovery area sections 71*a* and 71*b*, respectively.

Outlets 72 and 74, which also extend the full width of the furnace sections 28 and 30, are defined between the parallel portions of the partitions 20 and 22, and 24 and 26, respectively, at the lower portions of the vortex chambers 64 and 66. The outlets 72 and 74 feed into troughs 76 and 78 which are defined between the lower portions of the partitions 20 and 22, and 24 and 26, respectively. Situated between the troughs 76 and 78 and bounded by portions of the sidewalls 16 and 18 is a heat exchange section 80, the purpose of which is described below. As shown in FIG. 1, a pressure part seal 82 is located above the heat exchange section 80 to insulate the heat exchange section.

As shown in FIGS. 2-5, a plurality of partitions 84 divide the lower portion of the trough 76 and a plurality of partitions 86 divide the lower portion of the trough 78 into multiple alternatively disposed compartments 88 and 90 with like compartments given the same reference numerals. The compartments 88 are designed to receive the separated particulate material, or solids, from the separators 56 and 58 via the troughs 76 and 78 and then discharge the solids into the heat exchange section 80. The compartments 90 are designed to receive the solids from the heat exchange section 80 after they have been cooled and then discharge the solids into the respective beds of the furnace sections 28 and 30.

Figure 4:
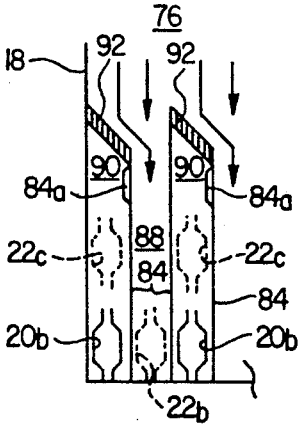
FIG. 4 shows a partially enlarged sectional view of a portion of the reactor taken along the line 4—4 of FIG. 3.
Figure 5:
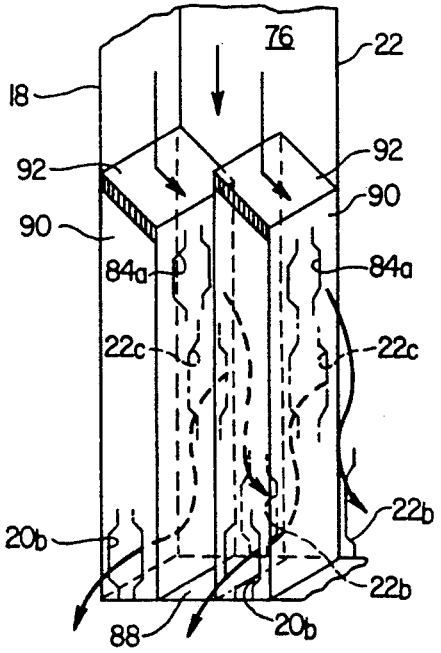
FIG. 5 shows an enlarged perspective view of the portion of the reactor shown in FIG. 4.

Toward this end and as shown in FIGS. 4 and 5, a slanted roof 92 blocks the top entrance of each of the compartments 90, so that all of the solids are originally directed into the compartments 88 as they fall through the troughs 76 and 78.

Openings **22*b* and 24*b* are provided through the lower ends of the partitions 22 and 24 in each of the compartments 88 for passing the solids into the heat exchange section 80. Openings 22*c* and 24*c* are provided through the partitions 22 and 24 in each of the compartments 90 at a higher elevation than the openings 22*b* and 24*b* for passing the solids from the heat exchange section 80 into the compartments 90 of the troughs 76 and 78. Openings 20*b* and 26*b* are provided through the lower ends of the partitions 20 and 26 to then pass the solids from the compartments 90 into the respective beds of the furnace sections 28 and 30. Additionally, bypass openings 84*a* and 86*a* are provided through the partitions 84 and 86 at a height above the openings 20*b*, 22*b*, 24*b* and 26*b* to allow the solids to pass directly from the compartments 88 to the compartments 90 without passing through the heat exchange section 80. The openings are shown schematically in the drawings for the convenience of presentation, it being understood that they are actually formed in a conventional manner by cutting away the fins or bending the vertically-disposed tubes which form the partitions 20, 22, 24 and 26** as is described below.

Figure 3:
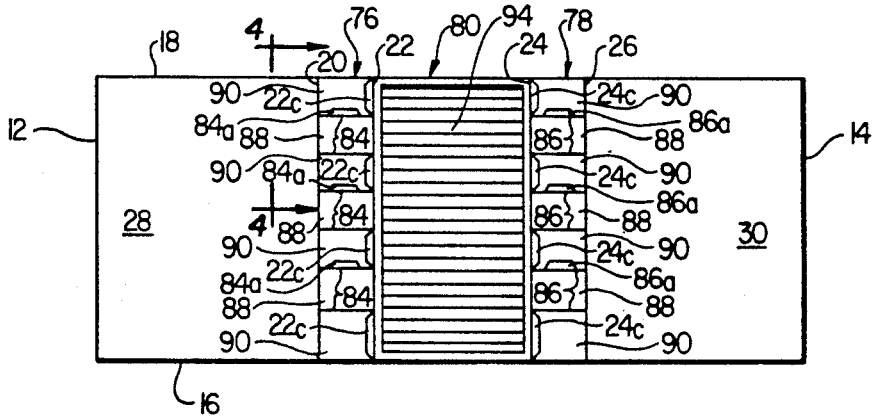
FIG. 3 shows a section taken along the line 3—3 of FIG. 1.

As shown in FIGS. 1 and 3, a bank of heat exchange tubes 94 are disposed in the heat exchange section 80. The tubes 94 extend between headers **96*a* and 96*b* (FIG. 1**) for circulating water, steam and/or a water-steam mixture (hereinafter termed "fluid") through the tubes.

Although not shown in the drawings, it is understood that perforated air distribution plates are suitably supported at the base of the ducts 76 and 78 and the heat exchange section 80 and define plenum chambers for introducing air from a suitable source into the ducts and heat exchange section to fluidize the solids therein and promote their required flow.

The walls 12, **12*a*, 14 and 14*a*, the partitions 20, 20*a*, 22, 22*a*, 24*a*, 26, and 26*a*, and the sidewalls 16 and 18** are each formed by a plurality of vertically-disposed tubes interconnected by vertically-disposed elongated bars, or fins, to form a contiguous, gas-tight structure. Since this type of structure is conventional, it is not shown in the drawings nor will it be described in further detail.

Flow circuitry is provided to pass fluid through the tubes to heat the fluid to the extent that it can be used to perform work such as, for example, driving a steam turbine (not shown). To this end, headers **98*a–e* are connected to the lower and upper ends, respectively, of the walls 12, 14, 12*a* and 14*a*, the partitions 20, 20*a*, 22, 22*a*, 24, 24*a*, 26 and 26*a* and the sidewalls 16 and 18** for introducing fluid to, and receiving fluid from, the tubes forming the respective walls.

It is also understood that the reactor 10 is equipped with additional flow circuitry including a steam drum 100, shown in FIG. 6, to provide a workable system for efficient transfer of heat from the reactor 10. Other heat, reheat and superheat functions, also not shown, are contemplated. Since these techniques are conventional, they will not be discussed further.

In operation, a particulate fuel material consisting, in general, of coal and limestone, is provided on the air distribution plates 32 and 34 and is ignited by light-off burners (not shown), or the like, while air is introduced into the plenum chambers 36 and 38. Additional fuel material is introduced through the distributor pipes 44 and 46 into the interiors of the furnace sections 28 and 30 as needed. As the combustion of the coal progresses, additional air is introduced into the plenum chambers 36 and 38 in quantities that comprise a fraction of the total air required for complete combustion so that the combustion in the lower portion of the furnace sections 28 and 30 are incomplete. The furnace sections thus operate under reducing conditions and the remaining air required for complete combustion is supplied through the openings 48 and 50 and the airports 52 and 54. The range of total air required for complete combustion can be supplied, for example, from 40%–90% through the plenum chambers 36 and 38 with the remaining air (10%–60%) supplied through the openings 48 and 50 and the air ports 52 and 54.

The high-pressure, high-velocity, combustion-supporting air introduced through the air distribution plates 32 and 34 from the plenum chambers 36 and 38 is at a velocity which is greater than the free-fall velocity of the relatively fine particles in the beds and less than the free-fall velocity of relatively course particles. Thus, a portion of the fine particles become entrained and pneumatically transported by the air and the combustion gases. This mixture of entrained particles and gases rises upwardly within the furnace sections 28 and 30 and passes through the inlet ducts 60 and 62 into the vortex chambers 64 and 66 of the separators 56 and 58, respectively. The inlet ducts 60 and 62 are arranged so that the mixture enters in a direction substantially tangential to the vortex chambers 64 and 66 and thus swirls around in the chambers. The entrained solid particles are thus propelled by centrifugal forces against the inner surfaces of the walls **12*a*, 22*a* and 20*a* of the separator 56, and against the inner surfaces of the walls 14*a*, 24*a* and 26*a* of the separator 58, where they then collect and fall downwardly by gravity through the outlets 72 and 74 and into the troughs 76 and 78** respectively.

The mixtures circulating in the vortex chambers 64 and 66 are directed to flow in a spiral fashion toward one end of the chambers, i.e., in a direction toward the sidewall 16. The pressure changes created by the spiral flows force the relatively clean gases concentrating along the central axes of the vortex chambers 64 and 66 toward the low pressure areas created at the openings of the cylinders 68 and 70. The clean gases thus pass into the cylinders 68 and 70 and exit to the heat recovery area 71. The clean gases from the separator 56 pass through the reheater (not shown) in the heat recovery area section **71*a*, whereas the clean gases from the separator 58 pass through the superheater and economizer (not shown) in the heat recovery area section 71*b*, thereby enabling the temperature of the clean gases passing through the reheater and superheater/economizer to be maintained at different levels by controlling combustion in the furnace sections 28 and 30**, respectively.

The solids which fall into the troughs 76 and 78 are directed into the compartments 88 by the slanted roofs 92. During start-up, fluidization air is passed into the lower portions of the troughs 76 and 78, however, no fluidization air is passed into the heat exchange section 80 thereby allowing it to "slump" and block the openings 22*b* and 24*b*. The solids thus build in the compartments 88 until they reach the bypass openings 84*a* and 86*a*, at which point the solids flow into the compartments 90 from where they are passed through the openings 20*b* and 26*b* into the respective beds of the furnace sections 28 and 30 where they mix with the other solids in the beds.

During steady-state operation of the reactor 10, heat is removed from the separated solids by passing them into the heat exchange section 80. As shown by the arrows in FIG. 5, this is accomplished by fluidizing the heat exchange section 80 such that the solids in the compartments 88 pass through the openings 22*b* and 24*b* into the heat exchange section 80. The solids are then carried by the fluidization air upwardly through the bank of heat exchange tubes 94 in the heat exchange section 80. As the solids pass the tubes 94, their heat transfers to the fluid flowing in the tubes thereby heating the fluid and cooling the solids. As the solids continue to rise, they pass through the openings 22*c* and 24*c* into the compartments 90 from where they are passed through the openings 20*b* and 26*b* into the respective beds of the furnace sections 28 and 30 where they mix with the other solids in the beds.

Fluid is introduced into the tubes forming the walls 12, 14, 12*a* and 14*a*, the partitions 20, 20*a*, 22, 22*a*, 24, 24*a*, 26 and 26*a* and the sidewalls 16 and 18 from the lower headers 98*a* and 98*d*. Heat from the fluidized beds, the gas columns, the separators 56 and 58 and the transported solids convert a portion of the fluid into steam, and the mixture of water and steam rises in the tubes and collects in the upper headers 98*b*, 98*c* and 98*e*. The steam and water are then separated in a conventional manner, such as in the steam drum 100, and the separated steam is passed through additional flow circuitry to perform work, such as to drive a steam turbine, or the like (not shown). The separated water is mixed with a fresh supply of feed water in the steam drum 100 and is recirculated through the flow circuitry using conventional risers, downcomers and feeders (not shown).

Likewise, in the preferred embodiment, steam is introduced into the tubes 94 in the heat exchange section 80 from the lower header 96*a*. Heat from the solids superheats the steam in the tubes 94, and the superheated steam collects in the upper header 96*b*. The superheated steam is then routed from the upper header 96*b* through additional flow circuitry to provide extra heat capacity or directly to end use, such as for a turbine.

It is thus seen that the reactor 10 of the present invention provides several advantages. For example, the provision of two horizontal cyclone separators integrated in the upper portion of the vessel of the reactor 10, with the integration of a recycle heat exchanger in the lower portion of the vessel, permits the separation of, the removal of heat from, and the recycling of the entrained solids in a manner which eliminates the need for additional bulky and expensive components. More particularly, the recycle heat exchanger provides additional heat to the fluid circuit associated with the reactor 10, such as a final superheat for the steam generated.

Further, the bypass openings 84*a* and 86*a* provide for the quick attainment of self-sustaining combustion temperatures within the furnace sections. The fuel beds must originally be ignited by external means, but as the furnace temperature increases, the combustion becomes self-sustaining and the ignitors can be turned off. It is therefore helpful during start-up to recycle the separated solids to the beds with a minimum of heat loss. The bypass openings 84*a* and 86*a* allow the separated solids to be routed directly to the furnace sections without passing over any heat exchange surfaces. Thus, the self-sustaining combustion temperature is more quickly attained. In addition, steam circuits in the recycle heat exchanger can be protected during start-up until sufficient steam can be generated by the reactor 10 to satisfactorily cool the tubes 94 to avoid exceeding the tube material design temperature.

The design of the recycle heat exchanger of the present invention also provides for the uniform distribution of the separated solids to the beds of the furnace sections. For uniform furnace bed temperature, it is important that the recycled solids become thoroughly mixed with the furnace bed materials as evenly as possible. The multiple openings 20*b* and 26*b* insure this.

By employing two furnace sections in connection with a heat recovery area having a parallel pass arrangement, greater control over the load range of the quantity and temperature of the flue gases passing through the reheater pass and the superheater/economizer pass, respectively, is afforded. Thus, the flexibility of the reactor over the load range is increased.

In addition, the employment of horizontal cyclone separator eliminates the need for pneumatic transport devices between the separating section and furnace sections of the reactor as well as the need for baffles and ducting usually required to redirect the combustion gases. Thus, the reactor 10 of the present invention is relatively compact and can be fabricated into modules for easy transportation and fast erection which is especially advantageous when the reactor is used as a steam generator, as disclosed here.

By forming the separators within the reactor vessel, the temperature of the separator boundary walls are reduced considerably due to the relatively cool fluid passing through these walls. As a result, heat loss from the separators is greatly reduced and minimizes the requirement for internal refractory insulation. The need for extended and expensive high temperature refractory-lined duct work and expansion joints between the reactor and cyclone separator, and between the latter and the separated solids heat exchange section, is also minimized. Further, this particular orientation of equipment lends itself to the design and construction of very large circulating fluidized bed steam generator systems, in the range of 500 MW and larger.

It is understood that variations in the foregoing can be made within the scope of the invention. For example, the walls of the vessel of the reactor 10 may be reconfigured to accommodate more than two furnace sections in communication with one or more horizontal cyclone separators in the upper portion thereof. Also, while the headers and flow circuitry have been described and shown in the drawings, it should be understood that any other suitable header and flow circuitry arrangement could be employed in connection with the present invention.

A latitude of modification, change and substitution is intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. A fluidized bed reactor, comprising:

a vessel;

means forming at least one furnace section in said vessel;

means for supporting a fluidized bed in each of said furnace sections for the combustion of fuel to generate heat and to generate a mixture of combustion gases and entrained particulate solids;

means forming a separating section in said vessel for receiving said mixture and for separating said entrained particulate solids from said combustion gases;

a heat recovery section formed in said vessel for removing heat from said separated solids;

a first compartment means disposed in said vessel for receiving said separated solids from said separating section;

a second compartment means disposed in said vessel;

means for permitting the passage of said separated solids from said first compartment means into said heat recovery section;

means for permitting the passage of said separated solids from said heat recovery section to said second compartment means; and means for permitting the passage of said separated solids from said second compartment means to said fluidized bed.

2. The reactor of claim 1 wherein said separating section comprises at least one cyclone separator, each of said cyclone separators comprising curved walls to define a generally cylindrical, horizontally disposed vortex chamber for separating said entrained particulate solids from said combustion gases by centrifugal forces, inlet means defined by said curved walls along the length of said chamber for receiving said mixture into said chamber, outlet means defined by said curved walls along the length of said chamber for discharging said separated solids, and a cylinder coaxially disposed within a portion of said chamber for discharging gases therefrom.

3. The reactor of claim 2 further comprising a plurality of tubes extending in a parallel relationship for at least a portion of their lengths over at least a portion of said curved walls, headers connected to the ends of said tubes, and means for circulating a cooling fluid through said headers and said tubes to cool said curved walls.

4. The reactor of claim 2 wherein said inlet means is defined by laterally spaced, longitudinal portions of said curved walls.

5. The reactor of claim 2 further comprising means extending from said outlet means of each cyclone separator to said first compartment means to pass said separated solids from said cyclone separator to said first compartment means.

6. The reactor of claim 1 wherein said heat recovery section comprises a bank of heat exchange tubes, header means connected to the ends of said tubes, and means for circulating a heat transfer fluid through said header means and said tubes for transferring the heat of said separated solids to said fluid.

7. The reactor of claim 1 further comprising means disposed between said separating section and said second compartment means for directing said separated solids into said first compartment means.

8. The reactor of claim 7 wherein said directing means comprises slanted roofs which cover said second compartment means.

9. The reactor of claim 1 further comprising bypass means for permitting the passage of said separated solids from said first compartment means into said second compartment means bypassing said heat recovery section.

10. The reactor of claim 9 wherein said first and second compartment means share a common wall and said bypass means comprises openings formed in said common wall.

11. The reactor of claim 1 wherein s id means for permitting the passage of said separated solids from said second compartment means to said fluidized bed comprises numerous openings registering with both said second compartment means and said fluidized bed to enhance uniform mixing of said separated solids in said fluidized bed.

12. The reactor of claim 1 further comprising partitions disposed in said vessel forming first and second furnace sections, said heat recovery section and first and second separating means such that said first separating means is disposed between said first furnace section and said heat recovery section and said second separating means is disposed between said second furnace section and said heat recovery section.

13. The reactor of claim 12 wherein all of said permitting means comprise openings formed in said partitions.

14. The reactor of claim 12 further comprising a first cyclone separator above said first furnace section for receiving said mixture of combustion gases and entrained particulate solids from said first furnace section, separating said entrained particulate solids from said combustion gases and delivering said separated solids from said first cyclone separator to said first compartment means and a second cyclone separator above said second furnace section for receiving said mixture of combustion gases and entrained particulate solids from said second furnace section, separating said entrained particulate solids from said combustion gases and delivering said separated solids from said second cyclone separator to said second compartment means.

15. A reactor comprising:

a vessel;

a first furnace section disposed in said vessel;

a second furnace section disposed in said vessel;

means in each of said furnace sections for receiving a combustible fuel for generating heat and combustion gases;

a first heat recovery area located adjacent said furnace sections;

a second heat recovery area located adjacent said furnace sections;

means for passing said combustion gases from said first furnace section to said first heat recovery area; and means for passing said combustion gases from said second furnace section to said second heat recovery area.

16. The reactor of claim 15 wherein said means for receiving a combustible fuel comprises means for supporting a fluidized bed of said fuel.

17. The reactor of claim 16 wherein said fuel is in the form of solid particulate material and wherein combustion gases in each of said furnace section mix with a portion of said particulate material, and further comprising separating means in each of said furnace sections for separating said gases from said particulate material.

18. The reactor of claim 15 wherein said first furnace section is operated independently of said second furnace section.

19. The reactor of claim 15 further comprising a reheater disposed in said first heat recovery area and a superheater and an economizer disposed in said second heat recovery area.

20. The reactor of claim 15 further comprising a housing disposed adjacent said vessel, and partition means in said housing for defining said first heat recovery area and said second heat recovery area.

21. The reactor of claim 15 further comprising partition means disposed in said vessel for defining said first heat recover area and said second heat recovery area.

22. A fluidized bed reactor comprising:

a vessel;

partitions disposed within said vessel to form first and second furnace sections, first and second troughs and a heat exchange section such that said first trough is disposed between said first furnace section and said heat exchange section and said second trough is disposed between said second furnace section and said heat exchange section;

means forming a fluidized bed in each of said furnace sections for the combustion of fuel to generate heat and to generate a mixture of combustion gases and entrained particulate solids;

means forming a separating section in said vessel for receiving s id mixture and for separating said entrained particulate solids from said combustion gases;

means for discharging said separated solids from said separating section to said troughs; and means for delivering said separated solids from said troughs to said heat exchange section and said furnace sections.

23. The reactor of claim 22 wherein said separating section comprises first and second cyclone separators, each of said cyclone separators comprising curved walls to define a generally cylindrical, horizontally disposed vortex chamber for separating said entrained particulate solids from said combustion gases by centrifugal forces, inlet means defined by said curved walls along the length of said chamber for receiving said mixture into said chamber, outlet means defined by said curved walls along the length of said chamber for discharging said separated solids, and a cylinder coaxially disposed within a portion of said chamber for discharging gases therefrom.

24. The reactor of claim 23 further comprising a plurality of tubes extending in a parallel relationship for at least a portion of their lengths over at least a portion of said curved walls, headers connected to the ends of said tubes, and means for circulating a cooling fluid through said headers and said tubes to cool said curved walls.

25. The reactor of claim 23 wherein said inlet means is defined by laterally spaced, longitudinal portions of said curved walls.

26. The reactor of claim 22 wherein said heat exchange section comprises a bank of heat exchange tubes, header means connected to the ends of said tubes, and means for circulating a heat transfer fluid through said header means and said tubes for transferring the heat of said separated solids to said fluid.

27. The reactor of claim 22 wherein said delivery means comprises openings formed in said partitions.

28. The reactor of claim 22 further comprising means for dividing said troughs into first and second sets of compartments and means for selectively directing said separated solids into said first sets of compartments.

29. The reactor of claim 28 wherein said directing means comprises slanted roofs disposed between said separating section and said second sets of compartments which cover said second sets of compartments for directing said separated solids into said first sets of compartments.

30. The reactor of claim 29 further comprising means for permitting the passage of said separated solids from said first sets of compartments into said heat exchange section, means for permitting the passage of said separated solids from said heat exchange section to said second sets of compartments, and means for permitting the passage of said separated solids from said second sets of compartments to said furnace sections.

31. The reactor of claim 30 wherein said permitting means comprises openings formed in said partitions.

32. The reactor of claim 28 or 30 further comprising bypass means for permitting the passage of said separated solids from said first sets of compartments into said second sets of compartments bypassing said heat exchange section.

33. The reactor of claim 32 wherein said bypass means comprises openings formed in said dividing means.

34. An apparatus for distributing particulate material comprising:

a vessel;

partition means for dividing said vessel into a furnace, a first compartment and a second compartment;

means for directing said particulate material into a section of said first compartment;

means for passing said particulate material from said first compartment section to said second compartment;

a bank of heat exchange tubes disposed in said second compartment for circulating a heat transfer fluid through said second compartment for transferring heat from said particulate material to said fluid;

means responsive to said particulate material in said second compartment reaching a predetermined condition for passing said particulate material from said second compartment to another section of said first compartment; and means for passing said particulate material from said other section of said first compartment to said furnace.

35. The apparatus of claim 34 further comprising bypass means for permitting the passage of said particulate material from said first compartment section to said other section of said first compartment for bypassing said second compartment.

36. The apparatus of claim 34 wherein said predetermined condition is the height of said particulate material in said second compartment.

* * * * *